US008316777B1

(12) United States Patent
Rosing

(10) Patent No.: US 8,316,777 B1
(45) Date of Patent: Nov. 27, 2012

(54) OVERBED TABLE WITH ARM SUPPORTS

(75) Inventor: Howard S. Rosing, Naples, FL (US)

(73) Assignee: Advanced Ergomed Innovations, LLC, Naples, FL (US)

( * ) Notice: Subject to any disclaimer, the term of this patent is extended or adjusted under 35 U.S.C. 154(b) by 83 days.

(21) Appl. No.: 12/967,732

(22) Filed: Dec. 14, 2010

Related U.S. Application Data

(60) Provisional application No. 61/286,090, filed on Dec. 14, 2009.

(51) Int. Cl.
*A47B 23/00* (2006.01)

(52) U.S. Cl. ..... 108/49; 108/50.01

(58) Field of Classification Search ..... 108/49, 108/42, 50.11, 65, 70, 73, 137, 143, 147.19, 108/106, 93, 144.1, 9, 6, 5; 248/118; 5/425; 297/115, 411.21, 411.3, 411.32, 411.38, 297/411.2

See application file for complete search history.

(56) References Cited

U.S. PATENT DOCUMENTS 2,346,919 A * 4/1944 Hillenbrand ..... 108/8
2,848,290 A * 8/1958 Doty ..... 108/147
D295,348 S * 4/1988 Muller ..... D6/420
4,852,500 A * 8/1989 Ryburg et al. ..... 108/50.01
5,004,196 A 4/1991 Gross
5,058,840 A * 10/1991 Moss et al. ..... 248/118.5
5,072,905 A 12/1991 Hyatt
5,147,090 A 9/1992 Mandell et al.
5,161,760 A 11/1992 Terbrack
5,342,006 A 8/1994 Tice
5,605,311 A 2/1997 McGrath
5,628,482 A 5/1997 Iravantchi et al.
D418,997 S * 1/2000 Leveen et al. ..... D6/420
6,244,546 B1 * 6/2001 Plamondon ..... 248/118
6,269,753 B1 * 8/2001 Roddan ..... 108/50.01
6,527,234 B1 3/2003 Kavacik
6,857,149 B2 2/2005 Hoggatt et al.
6,951,325 B2 10/2005 Lopez-Apodaca
7,032,522 B2 4/2006 George et al.
7,314,010 B2 * 1/2008 George et al. ..... 108/50.01
D588,829 S * 3/2009 Rheault et al. ..... D6/406.1
8,100,061 B2 * 1/2012 Hookway et al. ..... 108/50.01

* cited by examiner

*Primary Examiner* — Jose V Chen
(74) *Attorney, Agent, or Firm* — Cohen & Grigsby, P.C.

(57) ABSTRACT

An overbed table wherein a pedestal is attached to one end of a single support member and the other end of the support member is connected to a table assembly that includes a table surface. The center axis of the support member is located closer to a first edge of the table surface than the oppositely disposed edge of the table surface and arm supports connected to the table assembly are extendable past the first edge of the table assembly.

17 Claims, 9 Drawing Sheets

OVERBED TABLE WITH ARM SUPPORTS

CROSS REFERENCE TO RELATED APPLICATIONS

This application claims priority to U.S. Provisional Application Ser. No. 61/286,090, filed on Dec. 14, 2009.

BACKGROUND

Conventional overbed tables include a substantially flat table surface that provides little if any support for a user's arms during use. Such lack of support runs the risk of causing the user to suffer arm, wrist, or hand strain resulting from use of the overbed table.

SUMMARY

In an embodiment, an overbed table comprising a pedestal, a telescoping support member, a table surface, and an arm support is disclosed. A first end of the telescoping support member is attached to the pedestal. The telescoping support member has means for adjusting a height. The table surface is positioned at a second end of the telescoping support member. The arm support is adjacent to the table surface.

In another embodiment, an overbed table comprising a pedestal, a support member, a table surface, and an arm support is disclosed. The support member has a first end attached to the pedestal. The table surface is positioned at a second end of the support member. The arm support has a roller affixed thereto. The roller is configured to engage a guide track fixed to a bottom surface of the table surface to move the arm support between a storage position and a use position.

In another embodiment, an overbed table comprising a pedestal, a telescoping support member, a table assembly, and an arm support assembly is disclosed. The telescoping support member has a first end attached to the pedestal and means for adjusting a height. The table assembly comprises a table base supported on a second end of the telescoping member. A table frame is attached to the table base and has a recess. A table surface is attached to the table frame. An arm support assembly is coupled to the table assembly. The arm support assembly comprises an arm support configured for storage in the recess and is moveable to a use position out of the recess. A guide track is fixed within the recess. A roller is fixed to the arm surface and is configured to engage the guide track to move the arm support between the use and storage positions.

These and other details, objects, and advantages of the disclosed overbed table will become better understood or apparent from the following descriptions, examples, and figures showing embodiments thereof.

DETAILED DESCRIPTION

Figure 1:
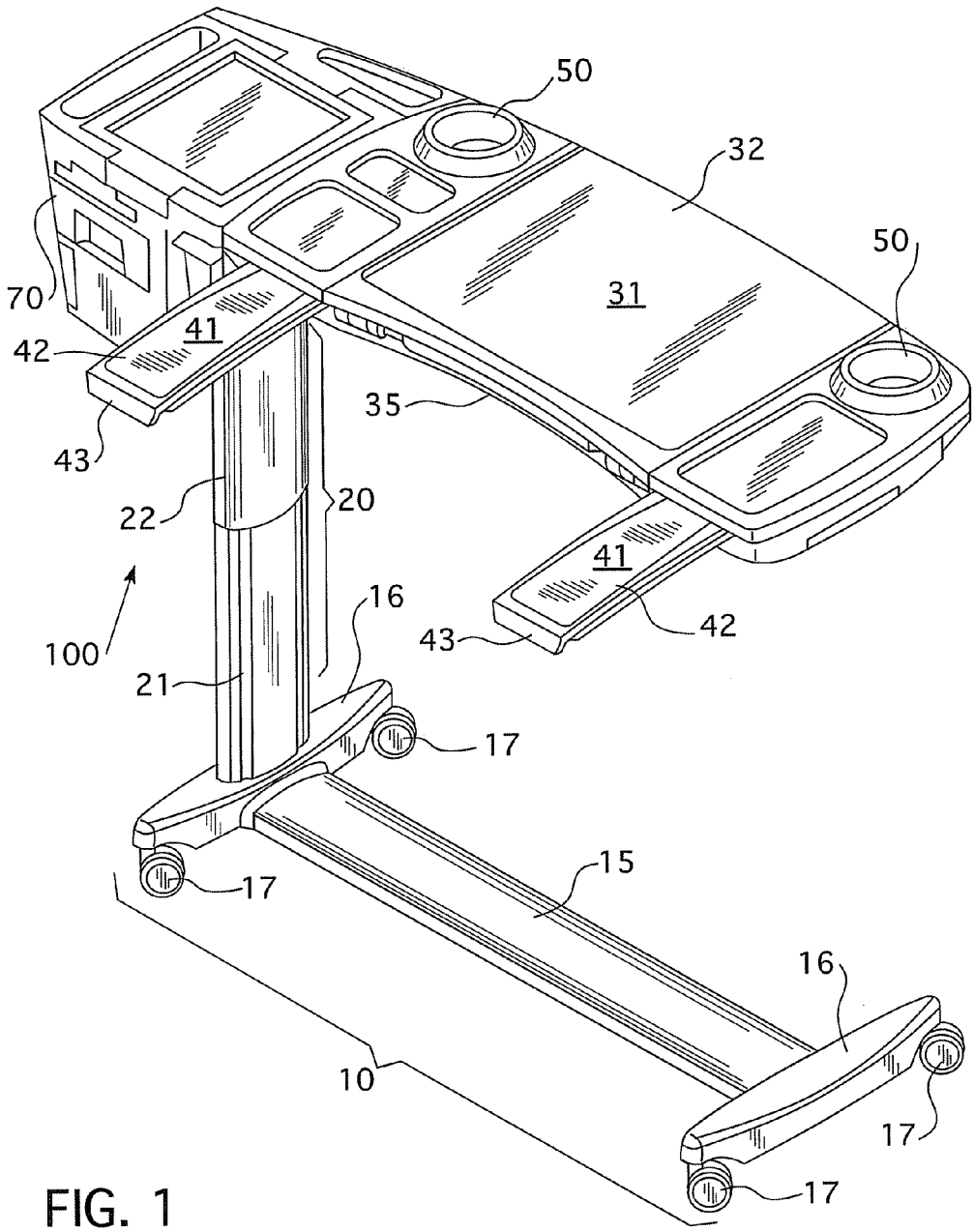
FIG. 1 is a perspective view of a first embodiment of the overbed table with the arm supports in the extended position.

An overbed table 100 is disclosed. Optionally, the overbed table 100 is configured to be reversible for use by both right-handed and left-handed patients. As described in more detail below, the overbed table 100 provides patients with a table surface 32, such as an eating, working, or interactive playing surface, and includes at least one arm support 42 that can support a patient's arm during use, thereby reducing or substantially eliminating arm, wrist, or hand strain. Optionally, the overbed table 100 includes a right arm support and a left arm support. As described in more detail below, the overbed table 100 is designed to counter any weight that a user places on the arm supports. The overbed table 100 is configured for use in combination with a hospital bed, chair, or wheelchair. Optionally, the overbed table 100 is configured with features found in conventional hospital rooms, including, for examples, a call button, a telephone, a television, a remote control, a video device, storage container 70, space, and a video monitor, and may be customized to the needs of a particular patient or of needs generally required by patients on a particular hospital floor or ward.

As shown generally in the figures, the overbed table 100 includes a pedestal 10 configured to be positioned under a hospital bed, wheel chair, or other chair. Pedestal 10 is generally H-shaped or C-shaped in plan view and includes a first member 15 positioned between two second members 16, where first member 15 is substantially perpendicular to second members 16 and second members 16 are substantially parallel to each other. The outer boundaries of second members 16 define an area within which the central forces of the arm supports 10 are located, as discussed in greater detail below. Preferably, the members 15, 16 of the pedestal are unitary. A plurality of casters 17, wheels, or the like are affixed to the pedestal 10 to facilitate moving and positioning the overbed table 100, such as for example at the four corners of the pedestal 10 as shown generally in the figures. Each caster 17 has a central axis.

Figure 4:
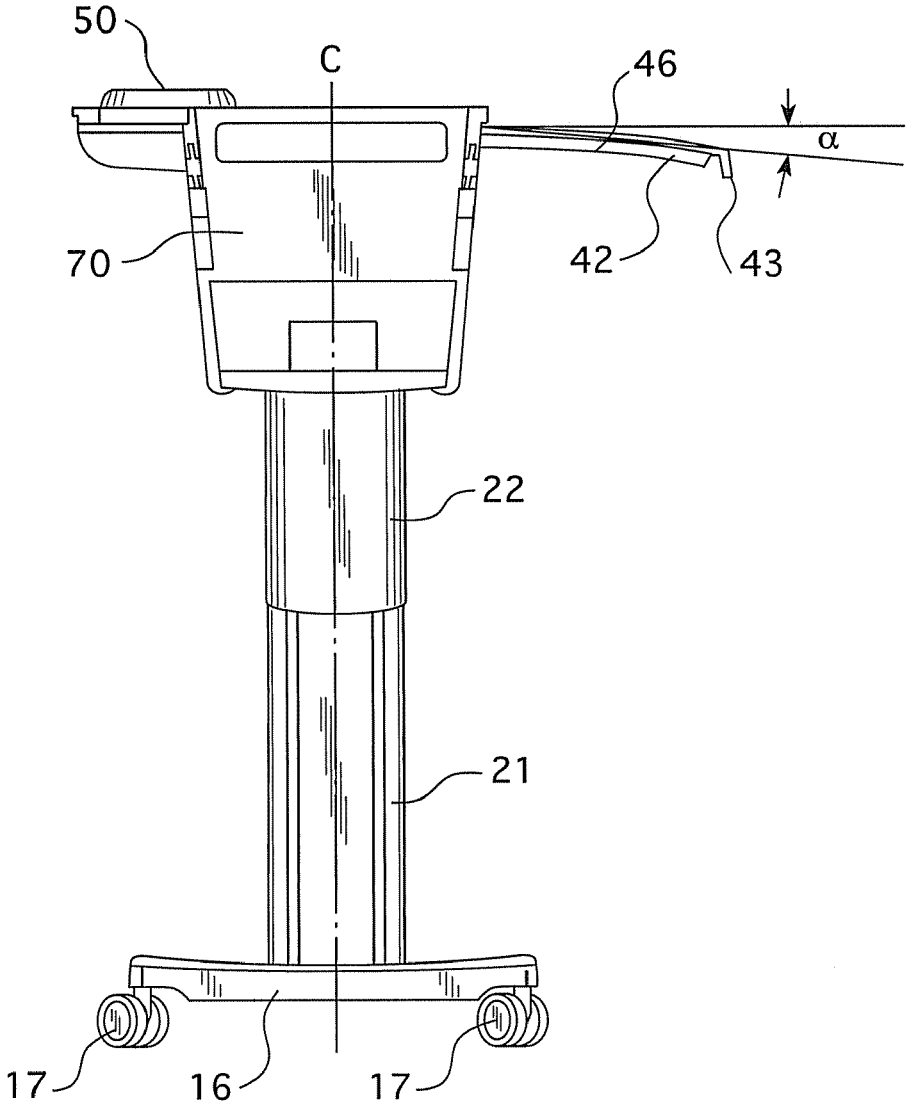
FIG. 4 is a side elevational view of the overbed table shown in FIG. 2.

The overbed table 100 also includes a support member 20 having a first end 25 attached to the pedestal 10. As shown in FIG. 4, the support member 20 has a central axis C that is offset from the center of the table surface 32 and is positioned closer to a first edge 35 of table surface in order to minimize sliding and tipping of the overbed table 100 when a user exerts downward force or pressure on one or both of the arm supports 42. In an embodiment, the support member 20 is telescoping and includes first and second pieces 21, 22 and means for adjusting a height 23 of the support member 20 to raise and lower the overbed table 100 in order to facilitate positioning of the overbed table 100 with respect to the hospital bed, wheel chair, chair, or the like. The support member 20 may include friction guides to prevent or minimize wear and damage as the support member 20 is raised and lowered. The telescoping support member 20 is controlled either manually and may be carried out by a gas-assisted method, or electronically, such as by a linear motor. In an example, first piece 21 is substantially square or rectangular. Optionally, the overbed table includes a pressure sensor (not shown) on a bottom surface of the table surface 32 (described below) or the table assembly 30 (described below) in order to control vertical movement of the overbed table 100 when a pressure is exerted, such as when the bed comes into contact with the patient, the bed, or the like.

Figure 6:
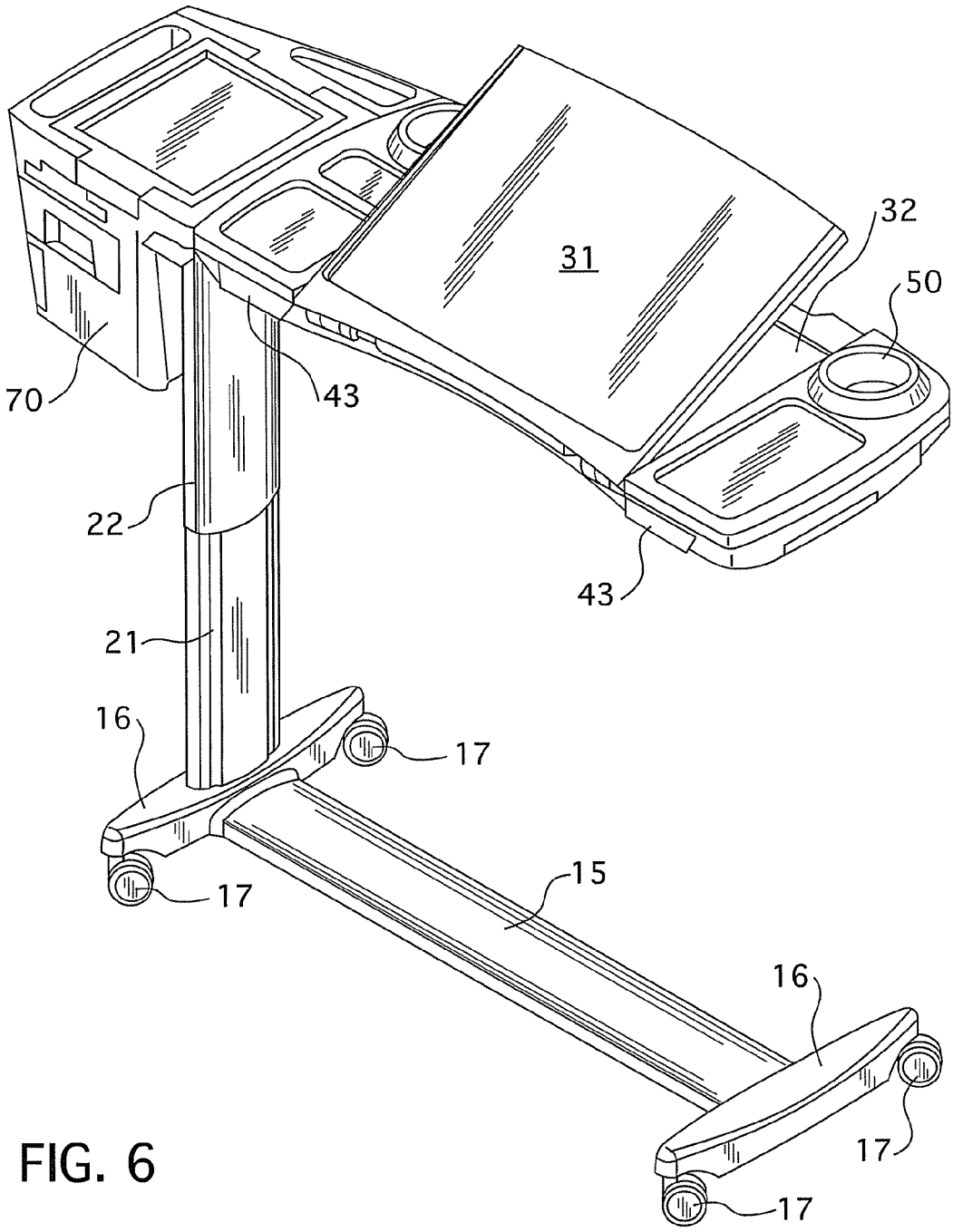
FIG. 6 is a perspective view of the overbed table shown in FIG. 1, showing the working surface in an inclined position.

As shown generally in the figures, the overbed table 100 also includes a table surface 32 positioned at a second end 26 of the support member 20. Table surface 32 is generally rectangular in shape and is defined by first 35 and third 37 substantially parallel edges and second 36 and fourth 38 substantially parallel edges, where second 36 and fourth 38 edges are substantially perpendicular to first 35 and third 37 edges. Table surface 32 is positioned in a plane along a first longitudinal axis A. Optionally, table surface 32 includes a working surface 31 that is adjustable and can be positioned at an incline between about 0° to about 90° relative to the plane. In use, working surface 31 rotates about first longitudinal axis A towards the user. FIGS. 1-4 show the table surface 32 positioned at an incline of about 0°. FIG. 6 shows the table surface 32 positioned at an incline of about 45°. The working surface 31 is adjustable either manually or electronically, such as by a motorized inclination control. In an example, inclination of the working surface 31 is accomplished by at least one hinge 39 or friction hinge affixed to the table surface. In another example, inclination of the working surface 31 is accomplished by gas dampers affixed to table surface. Optionally, the electronic control is hand-held and may include controls for external devices, such as for examples, televisions, wireless ports, docking stations, gaming devices, reading lamps, and the like.

Optionally, first edge 35 of the table surface, which is positioned closest to the patient during use, is curved in order to conform to the contour of a human chest so that the overbed table 100 can be positioned close to the patient during use for ease of access. First edge 35 may also include a channel (not shown) configured to accumulate or collect spilled food or liquids in order to prevent such spillage from reaching the patient or soiling the patient's bed linens.

Figure 5:
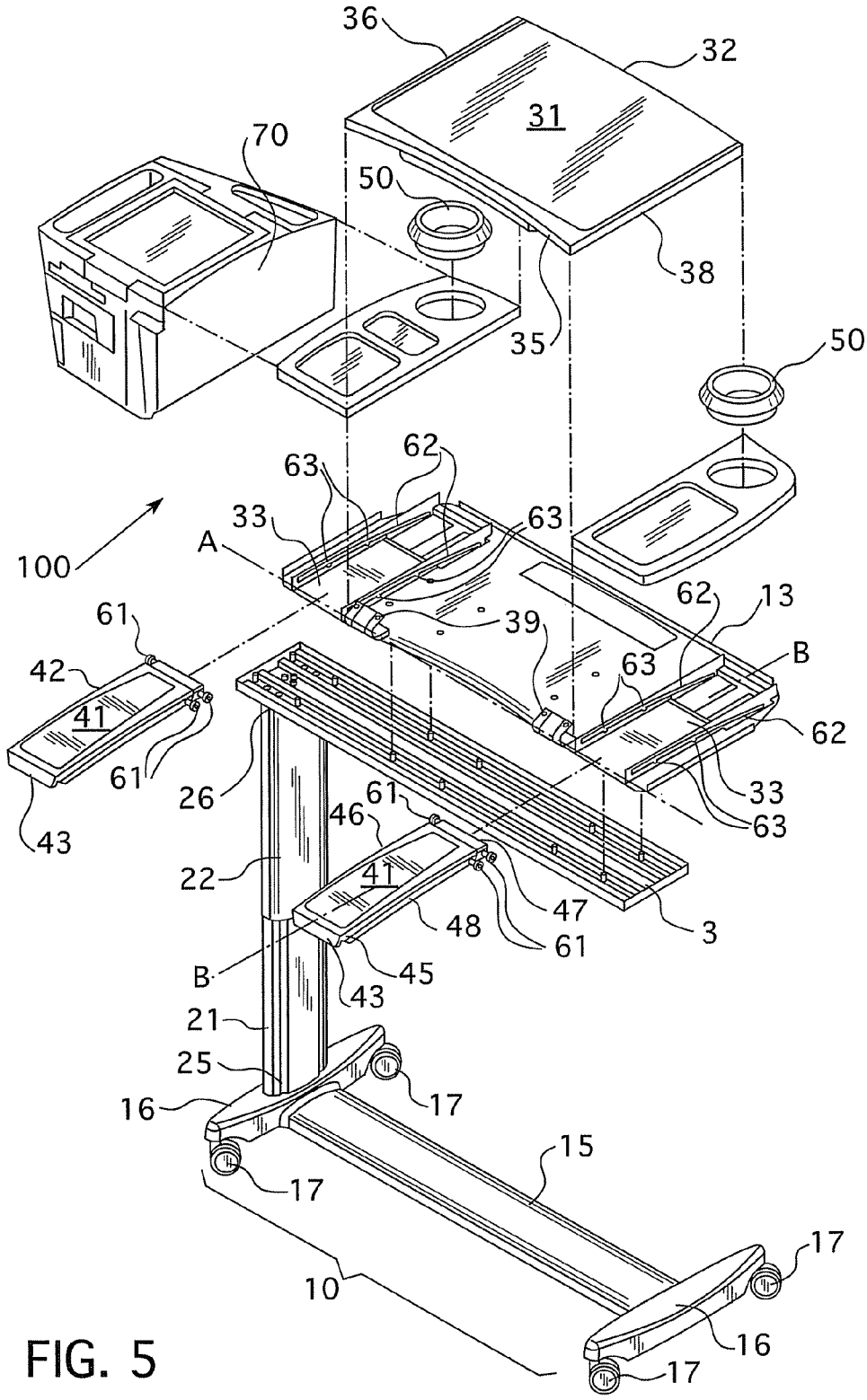
FIG. 5 is an exploded view of the overbed table shown in FIG. 1.

In an embodiment such as the one shown in FIG. 5, the table surface 32 is part of a table assembly 30 that also includes a table base 3 and a table frame 13. The table base 3 is attached to a second end 26 of the support member and the table frame 13 is attached to the table base 3. Table base 3 and table frame 13 are positioned in plane along first longitudinal axis B. The table surface 32, such as the one descried above, is attached to the table frame 13.

Working surface 31 of table surface may include an adhesive (not shown) configured to engage a bottom surface of an object positioned thereon so as to maintain the object in a substantially stationary position even when the table surface is in an inclined position.

Optionally, table surface 32 includes at least one holder 50. Holder 50 is configured to hold beverages containers and the like, and is configured to be adapted to hold an accessory such as a mirror, an iPad or a tablet mount. Holder 50 includes a channel 51 to capture an accessory cable through which the cable can be run during use to connect to an electrical outlet or the like.

Figure 2:
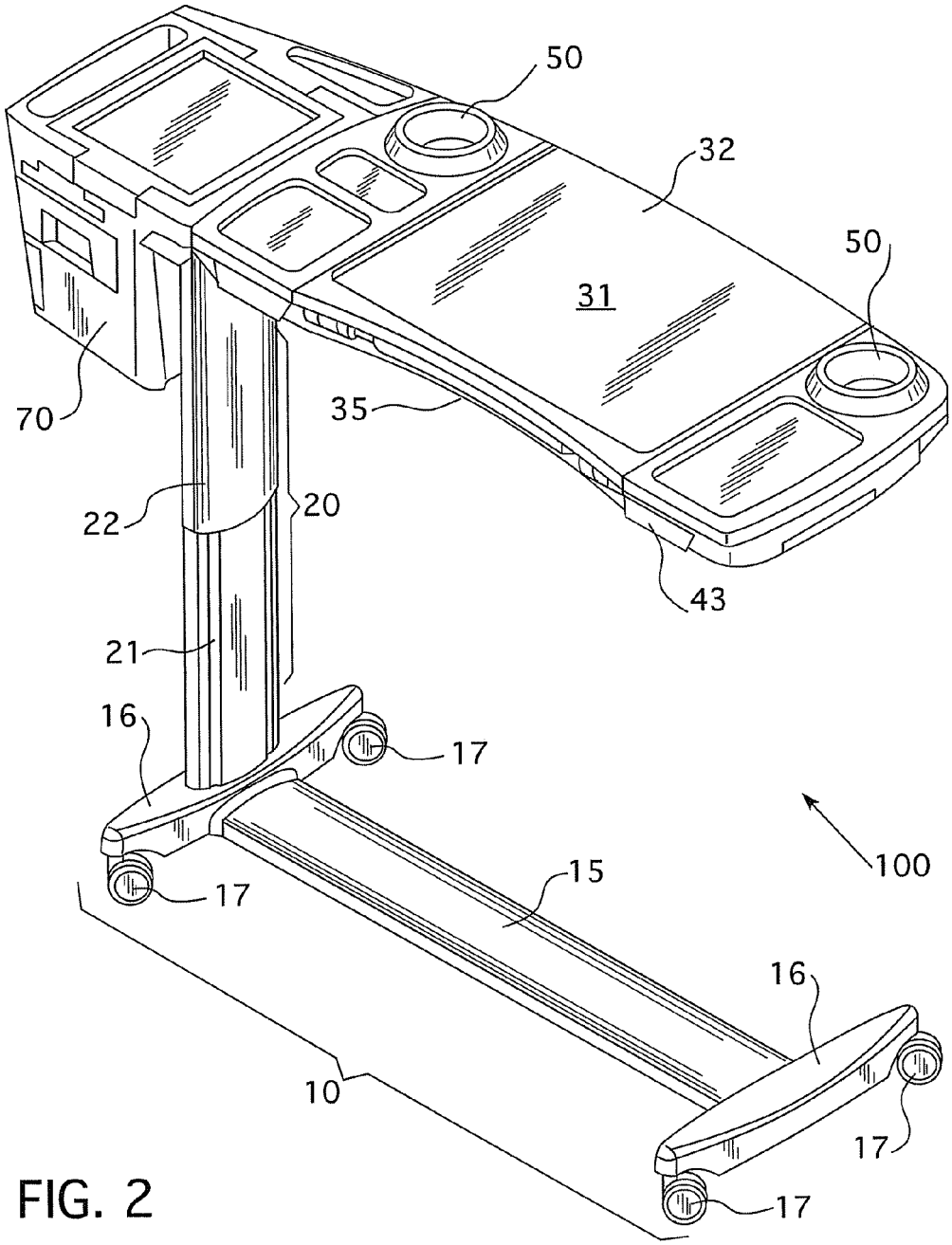
FIG. 2 is a perspective view of the overbed table shown in FIG. 1 with the arm supports in the closed position.
Figure 3:
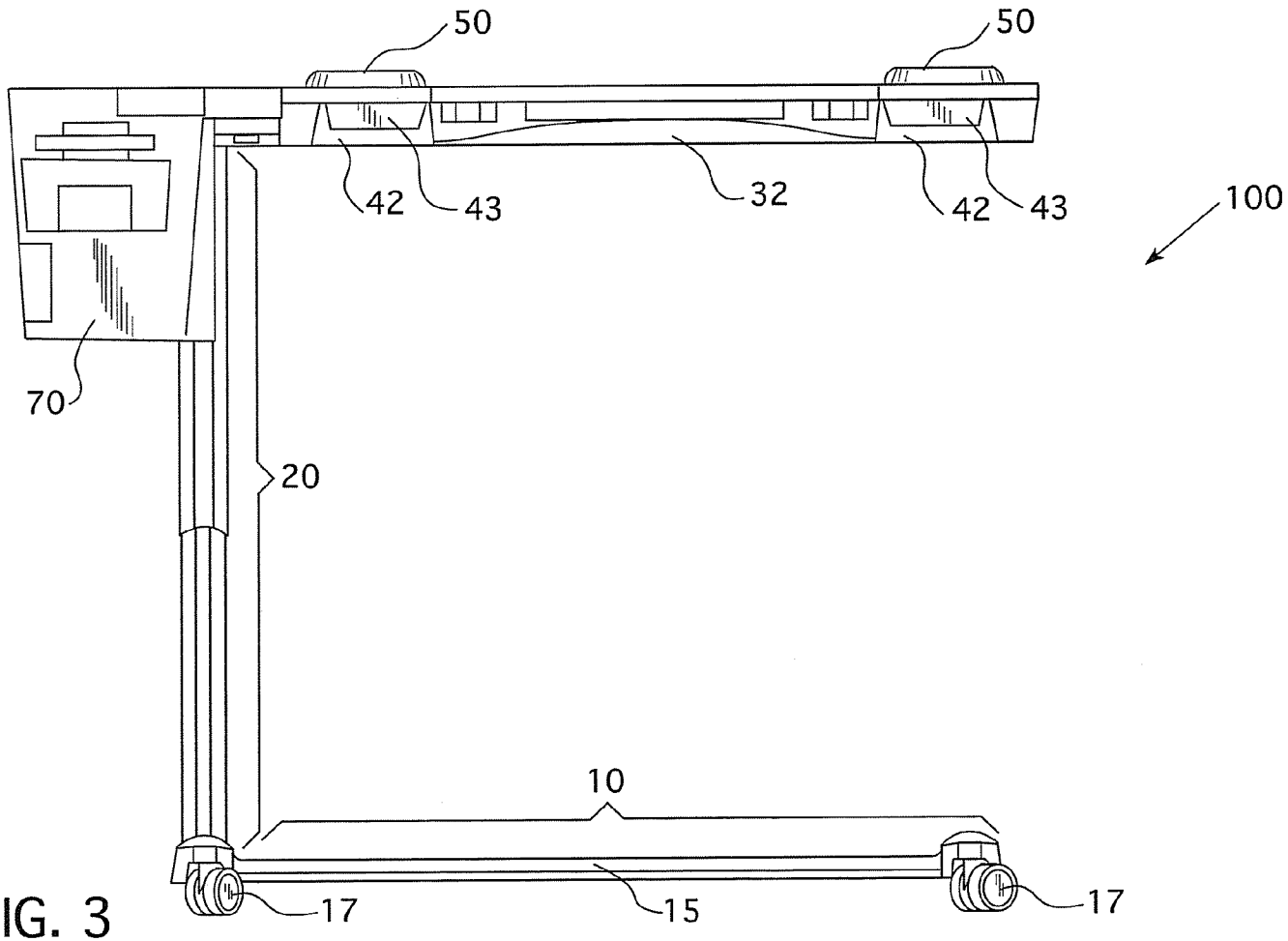
FIG. 3 is a front elevational view of the overbed table shown in FIG. 1.
Figure 8:
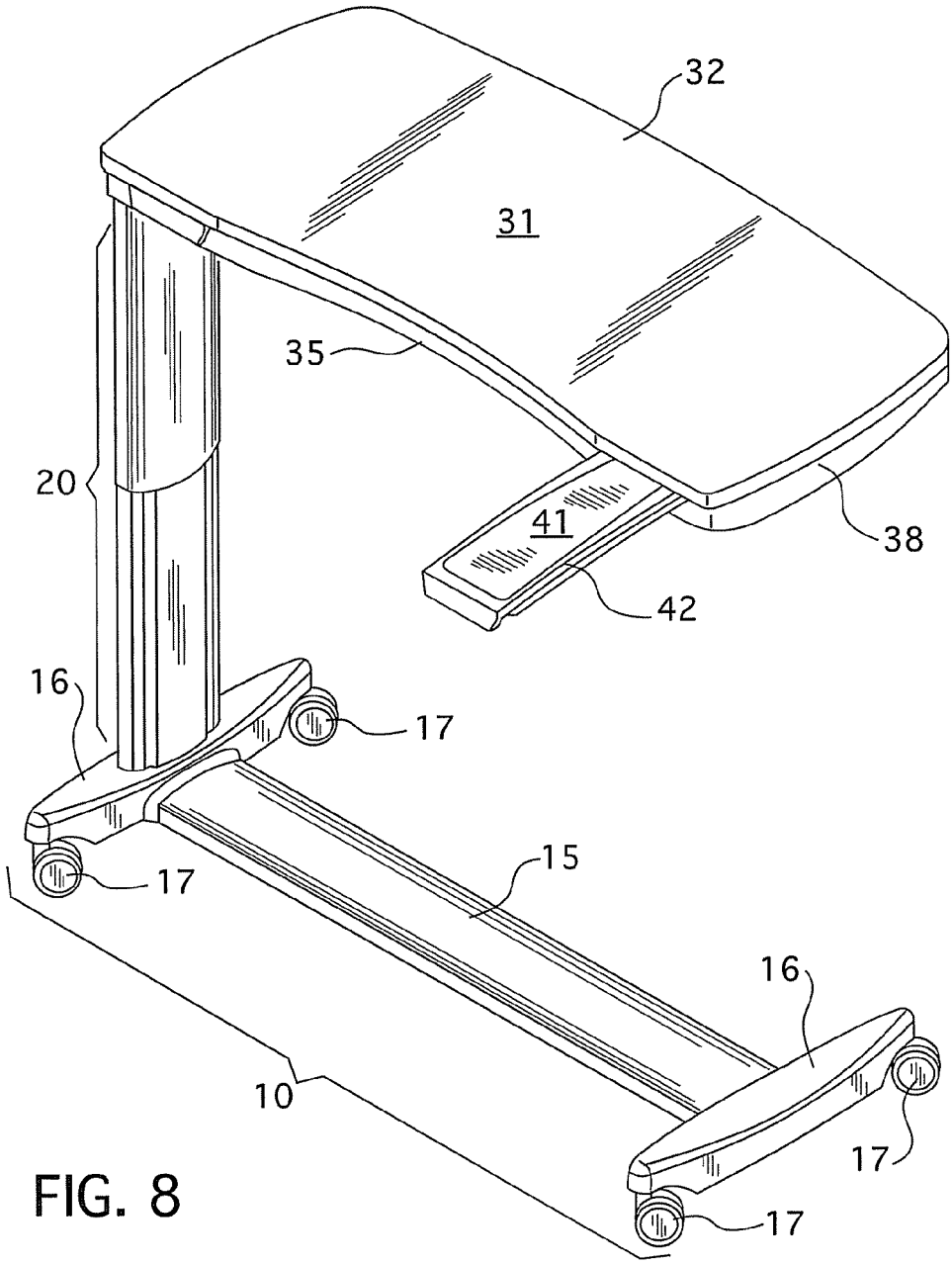
FIG. 8 is a perspective view of a second embodiment of the overbed table with one arm support in the closed position and one arm support in the extended position.
Figure 9:
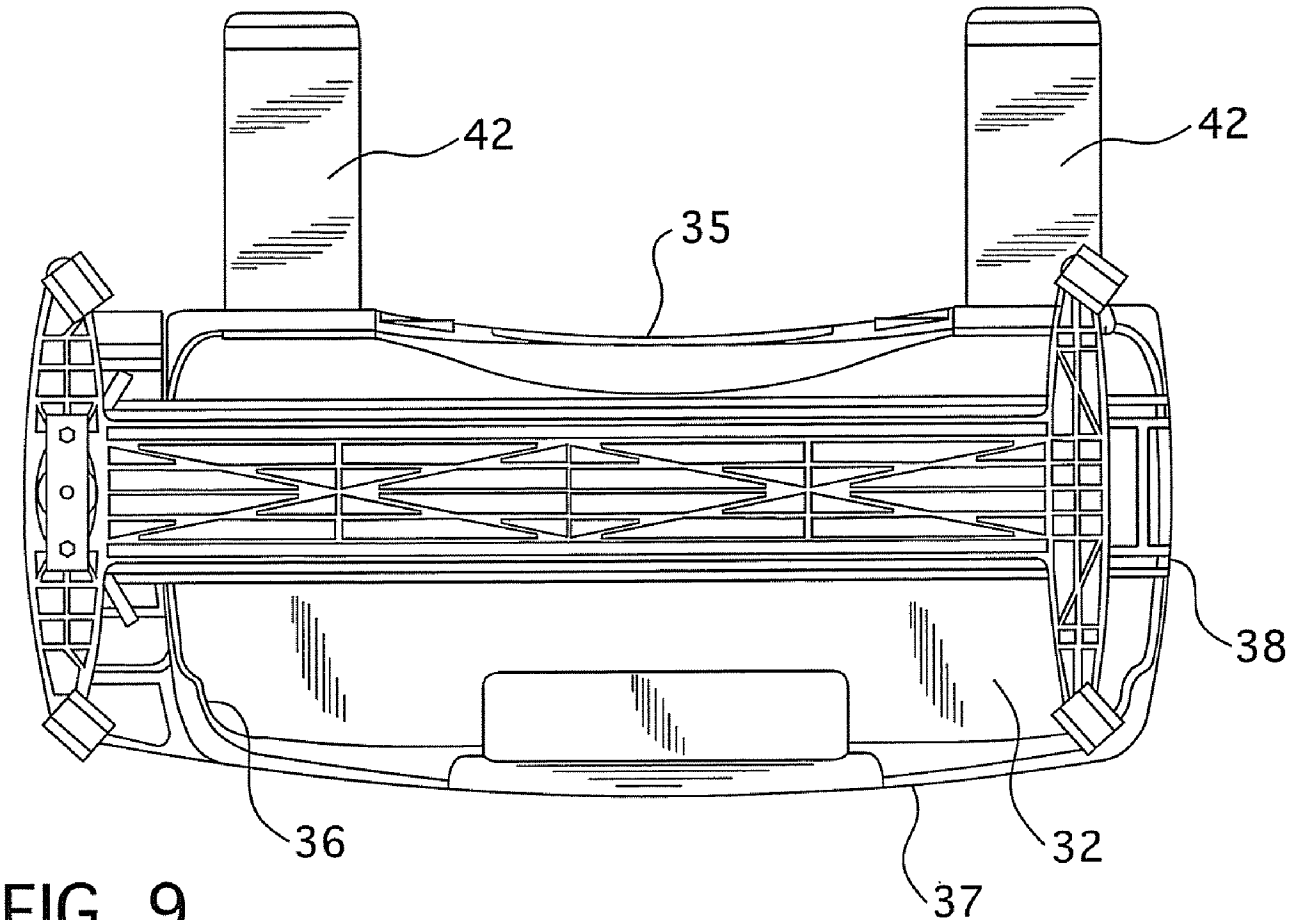
FIG. 9 is a bottom view of the overbed table shown in FIG. 8.

The overbed table 100 also has at least one arm support 42 adjacent to the table surface 32. The arm support 42 is configured to support a user's arm while the user is positioned at the overbed table 100. The overbed table 100 is configured to support downward pressure on the arm support 42 without tipping the overbed table 100, such as downward pressure from a user's arm, hands, and the like during use. Arm support 42 is substantially rectangular in shape and has an arm support surface 41 defined by four edges, where first 45 and third 47 edges are substantially parallel and second 46 and fourth 48 edges are substantially parallel, with the second 46 and fourth 48 edges being substantially perpendicular to the first 45 and third 47 edges. Arm support 42 has an internal frame (not shown). Arm support 42 includes sliding means 60 (described below) for moving arm support 42 between at least one extended position (FIGS. 1, 9) and a storage position (FIG. 2). Optionally, there is a plurality of extended positions. In FIG. 8, the right arm support 42 is shown in the extended position and the left arm support 42 is shown in the storage position. In the storage position, arm support 42 is positioned within plane and has a second longitudinal axis B that is substantially perpendicular to the first longitudinal axis A. In the extended position, arm support 42 is moveable about the first longitudinal axis A to an angle $\alpha$ of up to about 75° relative to the plane. This inclination creates an ergonomic fit adjustable to configure to a user's arms. In use, the central force of the arm support 42 is within the area defined by the pedestal 10.

As shown generally in the figures, the overbed table 100 may include two arm supports 42, one to support a user's right arm and one to support the user's left arm. The two arm supports 42 are positioned at opposite end portions of the table surface 32.

In an embodiment such as the one shown in FIG. 8, the arm support 42 is configured for storage below the table surface 32, such that in the storage position, the arm support 42 is positioned below the table surface 32 and first edge 45 of arm support is substantially aligned with first edge 35 of table surface. In an embodiment such as the one shown in FIG. 1, the table surface 32 has a recess 33 having dimensions configured to receive the arm support 42 such that arm support 42 is positioned in the recess 33 in the storage position. The first edge 35 of table surface has an opening 34 to the recess 33. Optionally, arm support 42 has a handle 43 affixed to the first edge 45 to facilitate movement of the arm support 42 between the storage and extended positions.

In the example shown in FIG. 5, sliding means 60 is an axle 61 that extends through second 46 to fourth 48 edges of arm support. Axle 61 is positioned closer to third edge 47 of arm support than to first edge 45. Optionally, two axles 61 extend through support 42 to provide strength and integrity to the arm support 42 and to prevent or minimize the occurrence of the arm support 42 torquing to either side. Opposing walls of recess 33 each have a groove 62 therein. The groove 62 is configured to receive a tip of the axle 61. Optionally, axle can include wheels that ride along groove 62. A stop 63 is provided in each groove 62 that registers to the forward axle 61. As described above, the arm support 42 is moveable about the first longitudinal axis A to tilt to an angle of up to about 75° relative to the plane. Sliding means 60 includes a locking mechanism (not shown) to lock the arm support 42 in the inclined and/or extended position. In use, axle 61 moves along grooves 62 to move arm support 42 between the storage and extended positions.

In another example (not shown), sliding means 60 is a roller affixed to arm support. Roller is configured to engage a guide track fixed to a bottom surface of the table surface to move the arm support between the storage position and the extended position.

In another example (not shown), sliding means is a groove 60 in each of the second and fourth edges of arm support that substantially aligns with a corresponding protrusion in table surface or table frame such that each protrusion engages the corresponding groove. In use, protrusion slides within groove to move arm support between the extended and storage positions.

Figure 7:
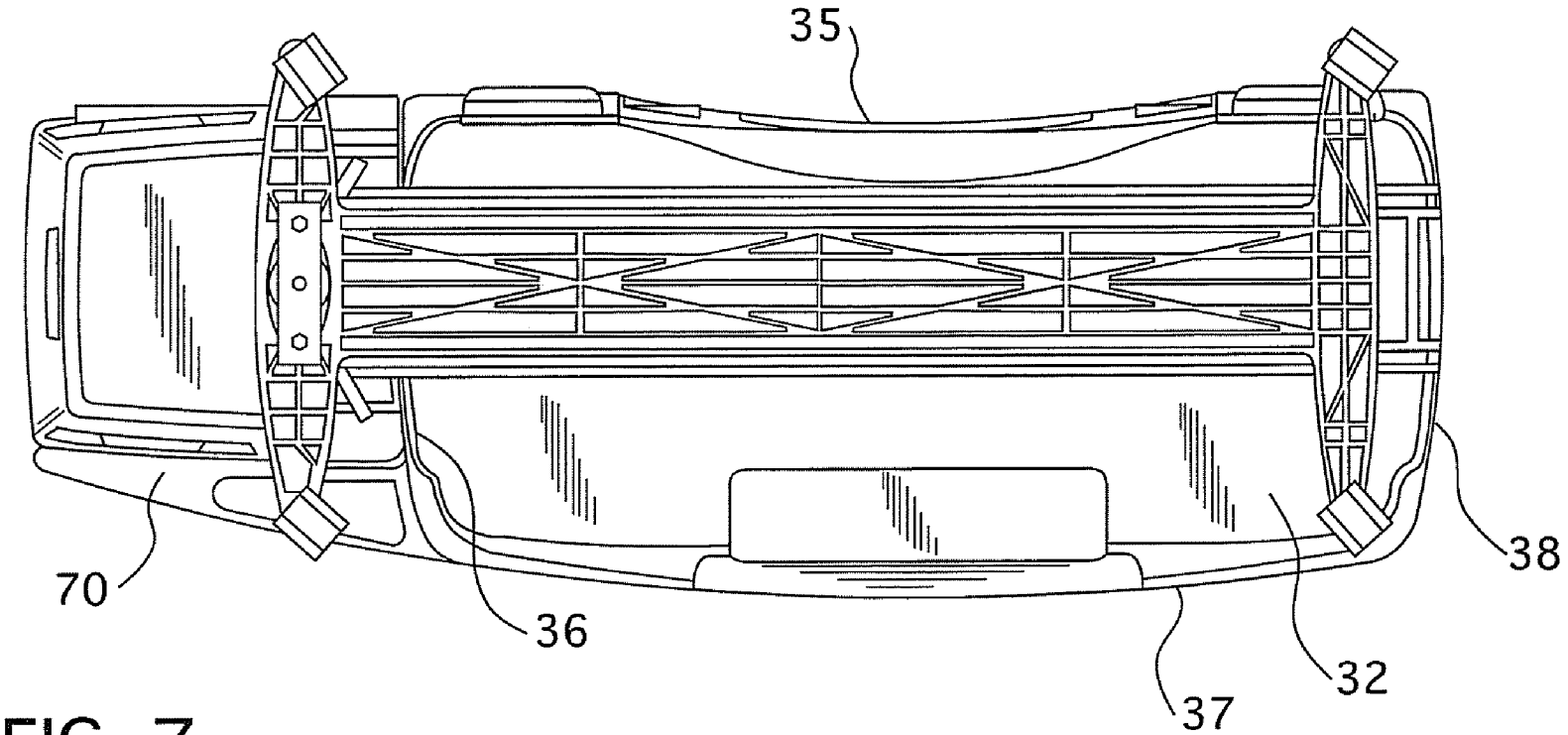
FIG. 7 is a bottom view of the overbed table shown in FIG. 1.

As shown in FIG. 7, in an embodiment there is an arm support assembly 40 coupled to the table assembly 30. The arm support assembly 40 comprises an atm support 42 and sliding means 60 such as those described above. Arm support 42 is configured for storage in a storage position in the recess 33. The arm support 42 is moveable between a storage and an extended position as described above.

While the foregoing has been set forth in considerable detail, it is to be understood that the drawings, detailed embodiments, and examples are presented for elucidation and not limitation. Design variations, especially in matters of shape, size, and arrangements of parts, may be made but are within the principles of the invention. Those skilled in the art will realize that such changes or modifications of the invention or combinations of elements, variations, equivalents, or improvements therein are still within the scope of the invention as defined in the appended claims.

I claim:

1. An overbed table, comprising:

a. a pedestal that defines an area;

b. a single telescoping support member that has a central axis and that has a first end attached to said pedestal, said telescoping support member also having means for adjusting the length of said telescoping support member;

c. a table assembly that is connected to a second end of said telescoping support member, said table assembly including a table surface that is oriented in a plane that includes a first longitudinal axis, said table surface having first and second oppositely disposed edges with the central axis of said telescoping support member being closer to the first edge of said table surface than the second edge of said table surface; and d. an arm support that is adjustably connected to said table assembly such that said arm support is selectively extendable from said table assembly to positions in which at least portions of said arm support extend past the first edge of said table surface, said arm support being extendable along a second longitudinal axis that is substantially perpendicular to said first longitudinal axis with said telescoping support member being closer to the first edge of said table surface to counter downward force on said arm support.

2. The overbed table as in claim 1, wherein a center of said arm support is substantially aligned along said second longitudinal axis and is within said area.

3. The overbed table as in claim 1, wherein said arm support is moveable between a storage position and at least one extended position.

4. The overbed table as in claim 1, wherein said table surface has a recess having dimensions configured to receive said arm support when said arm support is in a storage position.

5. The overbed table as in claim 4, wherein a first edge of said table surface has an opening to said recess.

6. The overbed table as in claim 1, wherein said arm support is moveable about said first longitudinal axis to an angle of up to about 75° relative to said plane.

7. An overbed table, comprising:

a. a pedestal that defines an area;

b. a single support member that has a central axis and that has a first end attached to said pedestal;

c. a table assembly that is connected to a second end of said support member, said table assembly including a table surface oriented in a plane that includes a first longitudinal axis, said table surface having first and second oppositely disposed edges with the central axis of said support member being closer to the first edge of said table surface than the second edge of said table surface;

d. an arm support that is adjustably connected to said table assembly such that said arm support is selectively extendable from said table assembly to positions in which at least portions of said arm support extend past the first edge of said table surface with said support member being located closer to the first edge of said table surface to counter downward force against said support member at times when said arm support is extended; and e. sliding means affixed to said arm support and configured to move said arm support between a storage position and at least one extended position.

8. The overbed table as in claim 7, wherein said table surface includes a working surface configured to be positioned at an incline between about 0° and about 90° relative to said plane.

9. The overbed table as in claim 7, further comprising a second arm support, wherein said arm supports are positioned at opposite end portions of said table surface, each said arm support having a second longitudinal axis substantially perpendicular to said first longitudinal axis.

10. The overbed table as in claim 9, wherein a center of said arm support is substantially aligned along said second longitudinal axis and is within said area.

11. The overbed table as in claim 7, wherein said arm support is moveable about said first longitudinal axis to an angle of up to about 75° relative to said plane.

12. The overbed table as in claim 7, wherein said table surface has a recess having dimensions configured to receive said arm support when said arm support in said storage position.

13. An overbed table, comprising:

a. a pedestal;

b. a single telescoping support member that has a central axis and that has a first end attached to said pedestal, said telescoping support member also having means for adjusting the length of said telescoping support member;

c. a table assembly, comprising:

i. a table base that is connected to a second end of said telescoping support member;

ii. a table frame attached to said table base and having a recess; and iii. a table surface that is attached to said table frame, said table surface having first and second oppositely disposed edges with the central axis of said telescoping support member being closer to the first edge of said table surface than the second edge of said table surface, said table surface positioned in a plane that includes a first longitudinal axis and attached to said table frame; and d. an arm support assembly that is coupled to said table assembly, comprising:

i. an arm support positioned along a second longitudinal axis that is substantially perpendicular to said first longitudinal axis and configured for storage in a storage position in said recess, said arm support also being moveable to an extended position out of said recess in which at least portions of said arm support extend past the first edge of said table surface and also being moveable about said first longitudinal axis to an angle of up to about 75 degrees with respect to the plane of said table surface, with said telescoping support member being located closer to the first edge of said table surface to counter force against the top of said arm support; and ii. sliding means configured to move said arm support between said extended and said storage positions.

14. The overbed table as in claim 13, wherein a center of said arm support is substantially aligned along said second longitudinal axis and is positioned within an area defined by said pedestal.

15. The overbed table as in claim 13, wherein said sliding means is an axle extending from a second to a fourth edge of said arm support and positioned closer to a third edge and configured to move along grooves, each groove being positioned in opposing walls of said recess to move said arm support between said storage and extended positions.

16. The overbed table as in claim 13, further comprising a second arm support assembly, wherein said arm supports are positioned at opposite end portions of said table surface.

17. The overbed table as in claim 13, wherein at least one of said telescoping member and said arm support is electronically moveable.

* * * * *